US005566699A

United States Patent [19]

Kou

[11] Patent Number: 5,566,699

[45] Date of Patent: Oct. 22, 1996

[54] SAFETY RUNNER FOR USE IN UMBRELLAS

[76] Inventor: Chin S. Kou, No. 27-1, Lane 188, Chin Mar Road, Sec. 3, Chang Hua City, Taiwan

[21] Appl. No.: 596,609

[22] Filed: Feb. 5, 1996

[51] Int. Cl.[6] ..... A45B 25/06

[52] U.S. Cl. ..... 135/28; 135/38; 135/41

[58] Field of Search ..... 135/28, 38, 39, 135/40, 41, 37

[56] References Cited

U.S. PATENT DOCUMENTS 1,612,290 12/1926 Isbell ..... 135/38

FOREIGN PATENT DOCUMENTS

| | | | |
|---|---|---|---|
| 0493867 | 7/1992 | European Pat. Off. | 135/28 |
| 1520766 | 4/1968 | France | 135/28 |
| 1242813 | 6/1967 | Germany | 135/28 |
| 15723 | of 1892 | United Kingdom | 135/41 |

*Primary Examiner*—Lanna Mai

*Attorney, Agent, or Firm*—Morton J. Rosenberg; David I. Klein

[57] ABSTRACT

The invention relates to an improved umbrella runner in which the body of the runner is provided with attachment means to which a cap is fixed for furnishing a shelter for sharp ends of finishing wires. The cap prevents people's fingers from an inadvertent touch with cutting wire ends during an opening or closing operation of an umbrella thereby providing better protection to users.

1 Claim, 5 Drawing Sheets

SAFETY RUNNER FOR USE IN UMBRELLAS

BACKGROUND OF THE INVENTION

In the structural arrangement of an umbrella, umbrella stretchers are secured to a runner by a steel wire. The steel wire, or called finishing wire, embraces the runner with two ends thereof twisted together. These sharp and cutting wire ends are exposed to the outside so that they often hurt users' fingers due to an unmindful action while opening or closing an umbrella. Therefore, it is desirable to have a safety protection to avoid such accidents.

In view of the above problems, the primary object of the invention is to provide a safety runner that comprises attachment means formed on one side thereof, and a cap affixed to the attachment means for sheltering twisted wire ends and preventing fingers from being injured.

The structure, features, and advantages of the invention will now be described in detail with reference to the accompanying drawings.

DETAILED DESCRIPTION OF A PREFERRED EMBODIMENT

Figure 1:
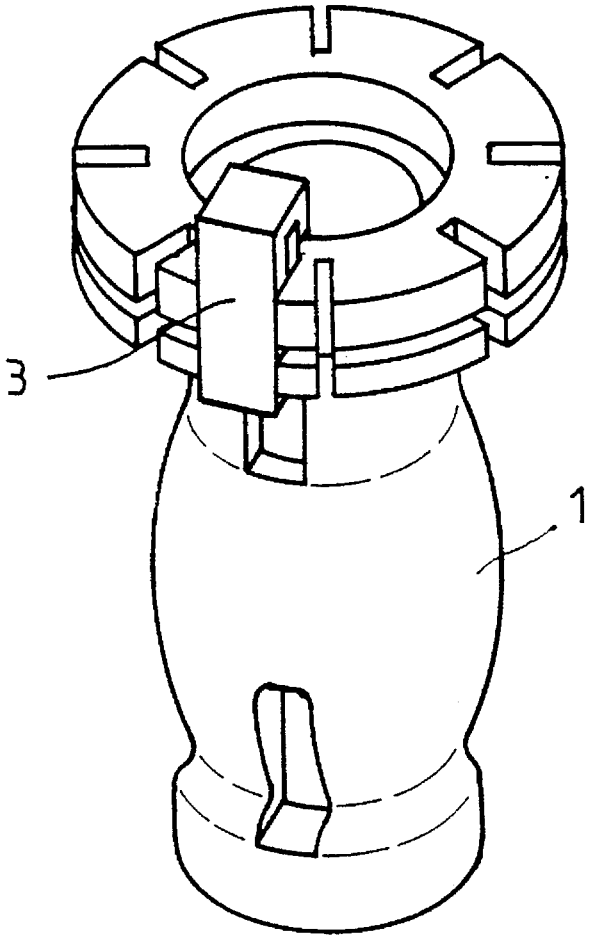
FIG. 1 is a perspective view of a safety runner of the invention.
Figure 2:
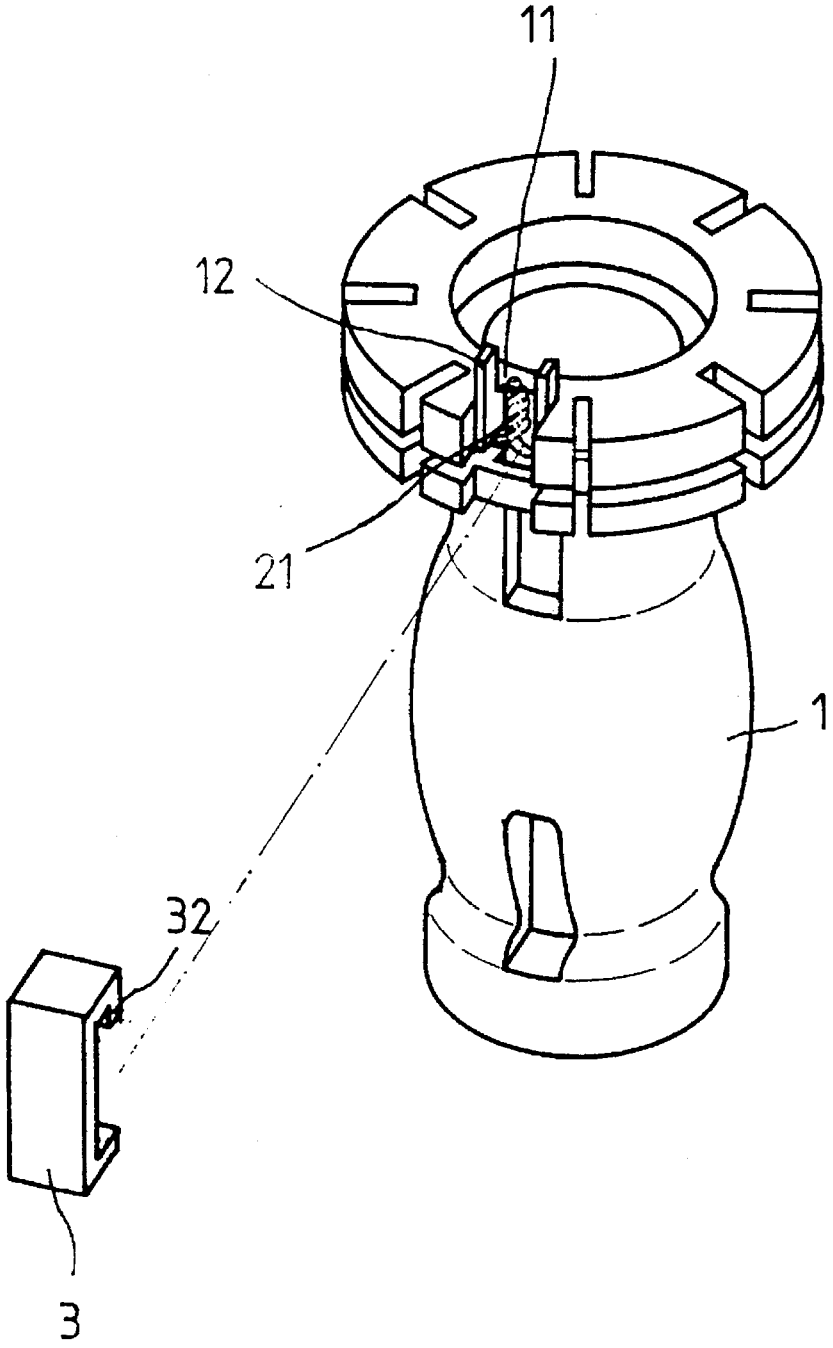
FIG. 2 is an exploded view of the safety runner of FIG. 1.
Figure 3:
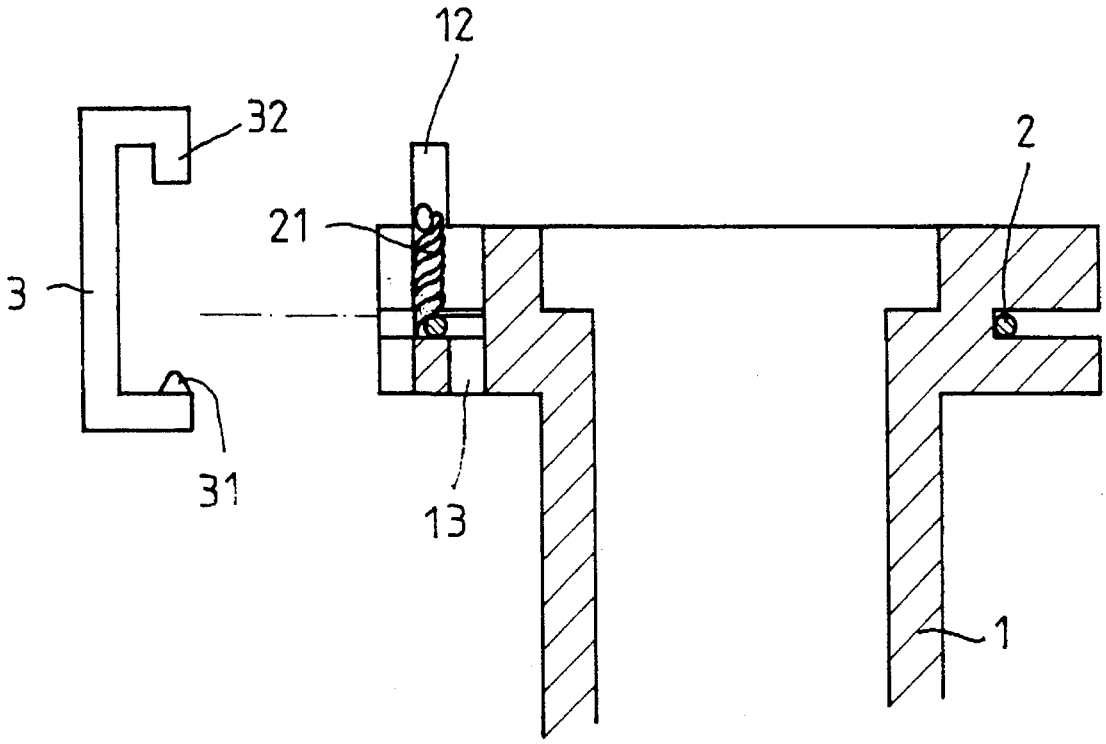
FIG. 3 and 4 are cross-sectional views schematically showing the attachment means and the cap of the safety runner of the invention.
Figure 4:
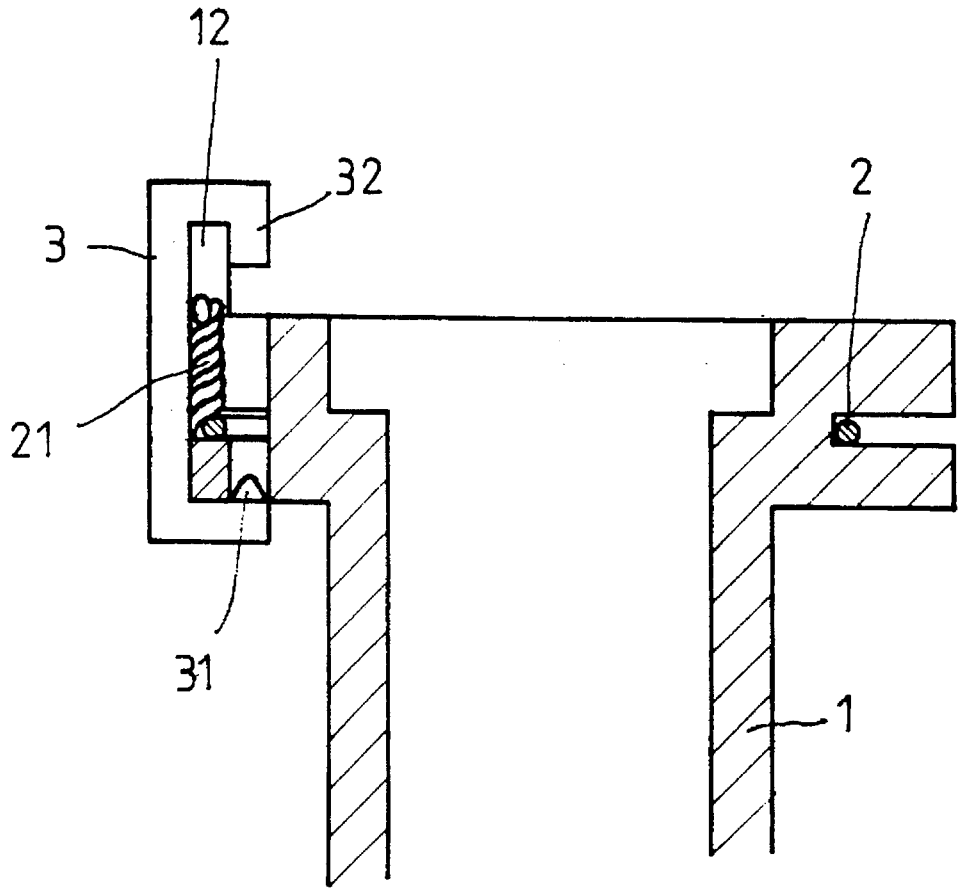
Figure 5:
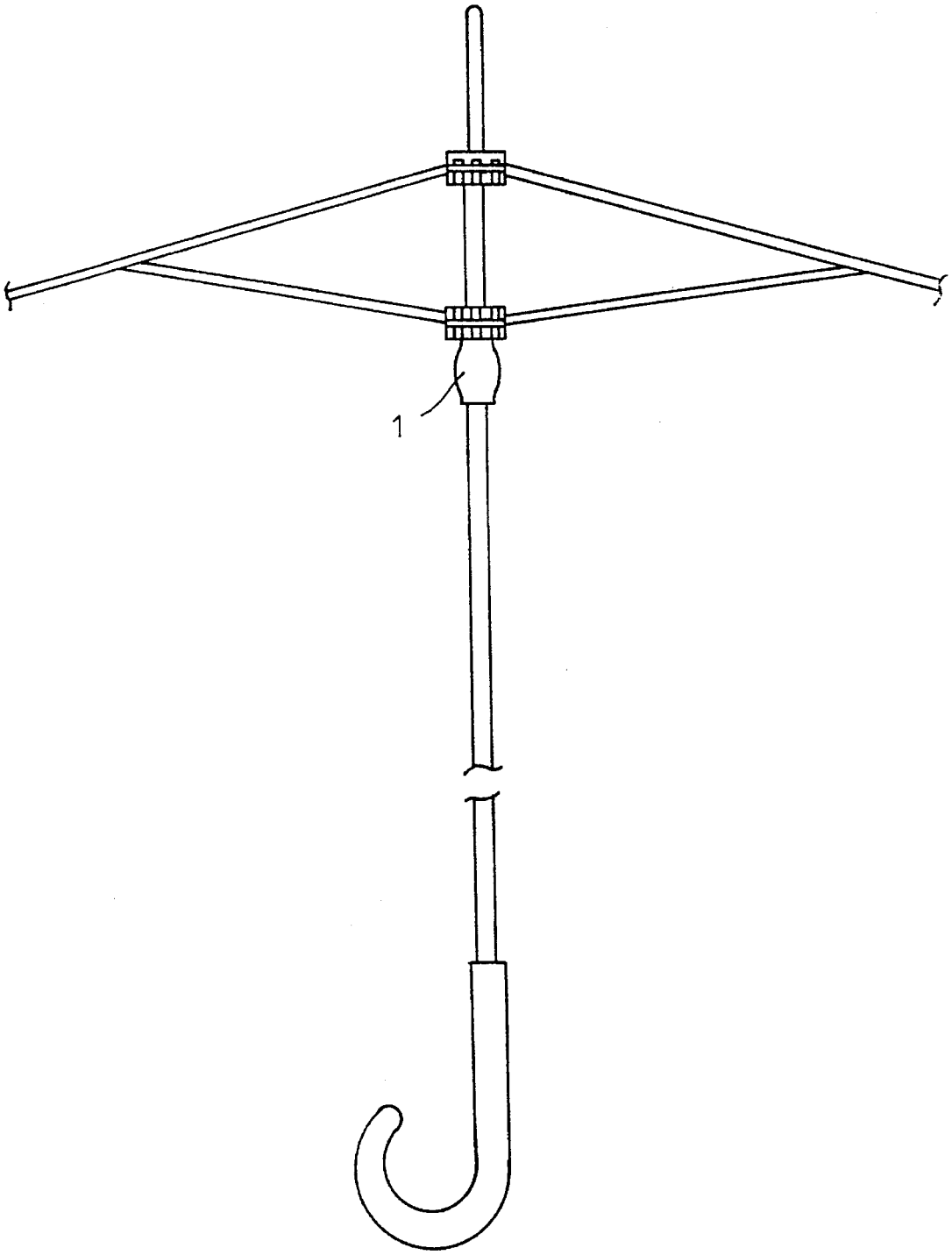
FIG. 5 shows the practice of the invention.

With reference to the drawings, the improved umbrella runner according to the invention comprises a runner body (1) with the attachment means provided on the side thereof.

The attachment means is composed of a recessed portion (11) and two engaging portions (12) that extend upwards. The wire end (21) formed by twisting together two free ends of a finishing wire is to be housed inside the recessed portion (11). The runner further comprises a U-shaped cap (3) that has a raised dot (31) formed on the inside bottom surface thereof and an inner flange (32) extending downwards from the inside top surface. The cap (3) is affixed to the runner body (1), with the inner flange (32) securing the engaging portions (12) and the raised dot (31) projecting into an opening (13) formed on the runner body (1). Consequently the cap (3) and the recessed portion (1) form the closed space encasing the wire end to prevent it from piercing into people's fingers.

From the above description, evidently the safety runner of the invention can provide users better protection and thoroughly eliminates the possibility of piercing people's fingers by exposed wire ends, achieving a safety effect.

What is claimed is:

1. A safety runner for use in an umbrella, comprising:

an attachment means formed on one side of said runner; said attachment means having a recessed portion within said runner accommodating twisted ends of said umbrella finishing wires, and two raised engaging portions;

a cap, wherein said cap has an U-shaped body including an inner flange formed on an inside top surface and a raised dot formed on an inside bottom surface;

said flange and raised dot allow said cap to be affixed to said attachment means to form a closed space for housing the twisted ends of said umbrella finishing wires.

* * * * *